United States Patent [19]

Chestnut

[11] Patent Number: 4,796,172

[45] Date of Patent: Jan. 3, 1989

[54] PORTABLE LIGHT SUPPORT APPARATUS AND METHOD OF ERECTING AND COLLAPSING SAME

[76] Inventor: H. Gary Chestnut, 7317 Impala Dr., Ventura, Calif. 93003

[21] Appl. No.: 118,760

[22] Filed: Nov. 9, 1987

[51] Int. Cl.[4] ..... F21V 21/06; F21V 21/26

[52] U.S. Cl. ..... 362/427; 362/190; 362/287; 362/431

[58] Field of Search ..... 362/287, 427, 285, 286, 362/418, 190, 191, 431, 430, 154, 61

[56] References Cited

U.S. PATENT DOCUMENTS

| | | | |
|---|---|---|---|
| 1,781,372 | 11/1930 | Denecke | 362/427 X |
| 4,181,929 | 1/1980 | Barber et al. | 362/192 |
| 4,220,981 | 9/1980 | Koether | 362/431 X |
| 4,232,357 | 11/1980 | Dietz | 362/191 X |
| 4,314,319 | 2/1982 | Terry et al. | 362/287 |
| 4,600,980 | 7/1986 | Dahlgren | 362/385 |

FOREIGN PATENT DOCUMENTS

| | | | |
|---|---|---|---|
| 64353 | 1/1942 | Norway | 362/427 |

*Primary Examiner*—Ira S. Lazarus
*Assistant Examiner*—Richard R. Cole
*Attorney, Agent, or Firm*—Marvin E. Jacobs

[57] ABSTRACT

A portable light support apparatus has a mobile frame, an electrical junction box mounted at one end of the mobile frame, an elongated support member pivotally mounted at one end by a swivel connector to the junction box for movement toward and away from the frame, and a bracing member which extends between and interconnects the frame and the support member. The support member at its opposite end mounts a high illumination quartz lamp at a location spaced remote from the junction box. The bracing member is extendable for placing the support member in an erected operative condition relative to the frame and the lamp remote from the frame. Also, the bracing member is contractable for placing the support member in a collapsed inoperative transport condition relative to the frame and the lamp adjacent to the frame. The frame is disposed in a generally horizontal position adjacent the ground with the wheels and handle of the frame in contact with the ground when the bracing member is extended to place support member in its erected condition. On the other hand, the frame is disposed in a generally upright position relative to the ground with its wheels in contact with the ground and its handle remote from the ground when the bracing member is contracted to place the support member in its collapsed condition.

22 Claims, 1 Drawing Sheet

10
12
14
16
18
18A
18B
20
22
24
26
28
30
32
34
36
38
40
42
44
46
48
50
52
54
56
58
60
62
64
66
68
2

PORTABLE LIGHT SUPPORT APPARATUS AND METHOD OF ERECTING AND COLLAPSING SAME

BACKGROUND OF THE INVENTION

The present invention relates generally to providing temporary lighting and, more particularly, is concerned with a portable light support apparatus and a method of erecting and collapsing the light support apparatus.

A wide variety of situations exist where the need for temporary lihhting arises because no other adequate sources of illumination are readily available. For instance, lighting of such nature is necessary at construction sites, at scenes of nighttime automobile accidents, or at unlighted outdoor locations where repair or other work is being carried out.

To meet this need effectively, the temporary lighting equipment should have a number of different capabilities. First, the equipment should be portable in nature. Its construction should allow it to be easily carried or towed to the desired location. Second, the equipment should require minimal skills to set it up for use and, conversely, to take it down after use. Third, the equipment should be able to carry its own power supply, if needed. Fourth, the equipment should employ only the amount of structure essential to provide a reliable light support. The weight of the equipment will then be kept to a minimum thereby making the equipment less costly in most cases and making the task of transporting the equipment as easy as possible. Fifth, the equipment should be collapsible to a smaller size when not in use to facilitate its storage in a minimum amount of space.

Many different structures for providing temporary lighting appear in the prior patent art. Representative of the prior art are the lighting support structures disclosed in U.S. Pat. No. Des. 136,799 to Vendope, and U.S. Pat. Nos. to Senter (1,622,057), Moehler (1,765,028), Rose (2,352,496), Allmand et al (2,899,540), Pile (3,783,262), Barber et al (4,181,929), Dietz (4,232,357), Dimiceli (4,363,084), Shirley (4,463,413), Gosswiller (4,488,209), Small (4,523,256), Dahlgren (4,600,980) and Welt (4,624,259). Many of these structures might operate reasonably well and generally achieve their objectives under the limited range of operating conditions for which they were designed. However, it appears that most, if not all, fail to provide one or more of the abovedescribed capabilities.

Consequently, a need still exists for a light support structure having increased and improved capabilities along the lines described above.

SUMMARY OF THE INVENTION

The present invention provides a portable light support apparatus designed to satisfy the aforementioned needs. The present invention also provides an extremely simple and effective method of erecting and collapsing the light support apparatus. The portable light support apparatus employs all of the abovedescribed capabilities. To summarize, the apparatus is very reliable, easily transportable and convertable, self-sufficient and readily storable in minimal space.

Accordingly, the present invention is directed to a portable light support apparatus which comprises (a) an elongated mobile frame; (b) a connecting means; (c) a lighting means; (d) an elongated support member; and (e) a bracing member. The connecting means is mounted on one end of the frame. The support member is pivotally mounted at one end by the connecting means to the one end of the frame for movement of the support member at an opposite end toward and away from the frame. The support member at its opposite end mounts the lighting means at a location spaced remote from the connecting means. The bracing member extends between and interconnects the frame and the support member.

More particularly, the bracing member is adjustable, or extendable, for placing the support member in an erected operative condition relative to the frame and the lighting means remote from the frame. The bracing member is oppositely adjustable, or contractable, for placing the support member in a collapsed inoperative transport condition relative to the frame and the lighting means adjacent to the frame. The frame is disposed in a generally horizontal position adjacent the ground when the bracing member is adjusted to place the support member in the erected condition relative to the frame. The frame is disposed in a generally upright position relative to the ground when the bracing member is oppositely adjusted to place the support member in the collapsed condition relative to the frame.

Also, the connecting means of the apparatus includes an electrical junction box mounted to the one end of the frame. The support element at its one end is pivotally mounted to the junction box. Further, the connecting means includes a swivel connector being pivotally mounted to the junction box and fixedly mounted to the opposite end of the support member. The support member is thereby pivotally movable via the swivel connector relative to the junction box toward and away from the frame.

Furthermore, the apparatus includes means in the form of a clip mounted on the frame for holding the bracing member in its contracted condition. The bracing member is composed of a plurality of parts being pivotally connected together and to the support member and the frame. The parts are unfolded into an end-to-end orientation with respect to one another when the bracing member is extended and folded into a side-by-side orientation with respective to one another when the bracing member is contracted.

Further, the present invention is directed to a method of converting the portable light support apparatus between erected and collapsed conditions. The converting method comprises the steps of: (a) providing an elongated frame having ground engaging support wheels rotatable mounted at one end of the frame and a handle attached to an opposite end of the frame; (b) providing an elongated support member pivotally mounted at one end to the one end of the frame for movement of the support member at an opposite end toward and away from the frame, the support member at the opposite end mounting a light at a location spaced remote from one end of the frame; (c) extending a bracing member to pivot the support member to the erected operative condition relative to the frame and the light remote from the frame; (d) disposing the frame in a generally horizontal position adjacent the ground with its wheels and handle in contact with the ground upon the extending of the bracing member; (e) contracting the bracing member to pivot the support member to the collapsed inoperative transport condition relative to the frame and the light adjacent to the frame; and (f) disposing the frame in a generally upright position relative to the ground with its wheels in contact with the ground and its handle remote from the ground upon the contracting of the bracing member.

More particularly, the extending of the bracing member is carried out by unfolding pivotally connected parts thereof into an end-to-end orientation with respect to one another. On the other hand, contracting of the bracing member is carried out by folding the parts thereof into a side-by-side orientation with respective to one another.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figures 1, 2, 3:
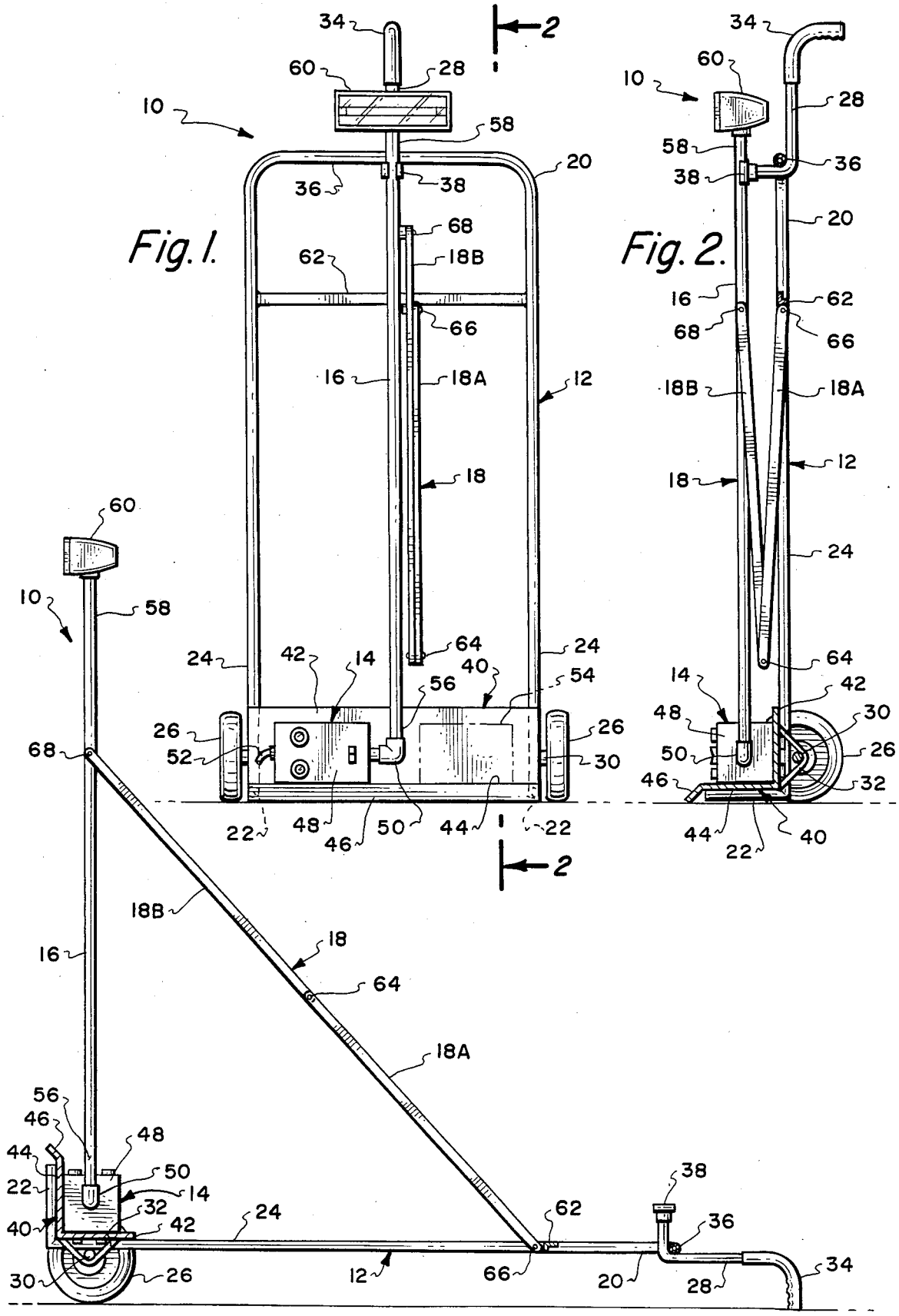
FIG. 1 is a front elevational view of a portable light support apparatus constructed in accordance with the principles of the present invention.
FIG. 2 is a side elevational view, partly in section, of the portable light support apparatus as seen along line 2—2 of FIG. 1, the apparatus being illustrated in a collapsed condition.
FIG. 3 is another side elevation view of the portable light support apparatus of FIG. 1, the apparatus being illustrated in an erected condition.

Referring now to the drawings, and particularly to FIGS. 1 and 2, there is shown a preferred embodiment of a portable light support apparatus, being indicated generally by the numeral 10 and constructed in accordance with the principles of the present invention. The light support apparatus 10 basically includes an elongated mobile frame 12, connecting means 14, an elongated support member 16 and a bracing member 18.

More particularly, the mobile frame 12 is in the form of a wheeled cart having a U-shaped tube 20 with a pair of ninety-degree upturned forward end portions 22 respectively on a pair of fore-and-aft extending leg portions 24 of the tube 20. The mobile frame 12 also includes a pair of ground engaging support wheels 26 and a handle 28. The wheels 26 are spaced apart and rotatably mounted at a forward end of the frame 12 by a common axle 30. The axle 30 is supported between respective brackets 32 attached inside the frame tube leg portions 24 immediately rearwardly of the upturned forward end portions 22 thereof.

The handle 28 is disposed at an opposite, rearward end of the frame 12 where a person can easily grip it for moving and manipulating the position of the support apparatus 10. More specifically, the handle 28 has a gripping sheath 34 fitted on its rear arcuate-shaped portion and is rigidly attached at its forward portion to the U-shaped frame tube 20 at the middle of a base portion 36 thereof. The base portion 36 of the U-shaped frame tube extends transversely between and integrallyinterconnects with the rearward ends of the fore-and-aft leg portions 24 of the tube 20. The handle 28 is oriented generally perpendicular to the tube base portion 36 and projects forwardly thereof at its forward end where the handle 28 mounts a C-shaped retaining clip 38, the purpose for which will be described later.

The frame 12 also includes a reinforcing means in the form of a platform 40 which extends transversely between and is rigidly connected to the leg portions 24 of the frame tube 20 at the forward end of the frame 12. The platform 40 is composed of a pair of flat plates 42, 44 being rigidly connected together in a ninety-degree angular relationship. One plate 42 of the platform 40 overlies, spans and is rigidly attached to the forward ends of the leg portions 24, whereas the other plate 44 overlies, spans and is rigidly attached to the upturned forward end portions 22 on the leg portions 24. The support wheels 26 are located immediately outwardly of the opposite ends of the plates 42, 44 of the platform 40. The other plate 44 of the platform 40 extends outwardly beyond the peripheries of the wheels 26 and includes a forwardly-bent flange portion 46, the purpose for which will be described later.

The connecting means 14 of the apparatus 10 preferably is composed of an electrical junction or "J" box 48 and an elbow-shaped swivel connector 50 both of which are mounted at the forward end of the frame 12 between the wheels 14. The box 48 is mounted on the plates 42, 44 of the platform 40 along the left half thereof, as viewed in FIG. 1. An electrical supply cord 52 extends into one side of the box 48 and the swivel connector 50 is rotatably mounted to the opposite side of the box 48. There is sufficient space along the right half of the platform 40, as viewed in FIG. 1, for placement of a battery or generator, such as represented by the dashed block 54.

The elongated support member 16 of the apparatus 10 is in the form of a tubular piece of conduit. The support member 16 is pivotally mounted at its forward end 56 to the J box 48 via the swivel connector 50. More particularly, the support member 16 is rigidly attached to the swivel connector 50; thus, the rotatable mounting relationship of the connector 50 to the J box 48 allows pivotal movement of the support member 16 relative to the J box 48 such that its opposite rearward end 58 can be moved toward and away from the frame 12. Specifically, the support member 16 is pivotal in a plane which extends generally perpendicular to the plane defined by the U-shaped frame tube 20.

The support member 16 at its rearward end 58 mounts a lighting soucce 60, being preferably in the form of a high illumination quartz lamp, at a location spaced remote from the J box 48 and forward end of the frame 12. The lamp 60 is thereby mounted for movement toward and away from the rearward end of the frame 12 concurrently with such movement of the support member 16. The lamp 60 is coupled to the rearward end 58 of the support member 16 by a suitable connector (not shown) which allows adjustment of the lamp 60 to various angular positions about the support member rearward end 58. Both the swivel connector 50 and the support member 16 have hollow interiors providing a path for passage of the electrical cord 52 from the interior of the J box 48 to the lamp 60 for electrically connecting the lamp either to a remote source of electrical power or to the battery or generator 54 carried on the platform 40.

The bracing member 18 of the apparatus 10 extends between and interconnects a cross member 62 of the frame 12 and the support member 16. The cross member 62 extends transversely between and is fixed at its opposite ends to the leg portions 24 of the frame tube 20. The cross member 62 is located at a distance along the frame 12 from its rearward end equal to about one-fourth of the length of the frame 12; the bracing member 18 is attached at a comparable location along the support member 16 with respect to its rearward end 58. The bracing member 18 is composed of a pair of similar elongated bars 18A, 18B being pivotally connected together at 64 and respectively to the frame cross member 62 at 66 and to the support member 16 at 68. The bars 18A, 18B unfold into an end-to-end orientation with respect to one another, as shown in FIG. 3, when the bracing member 18 is extended to its maximum length and fold into a side-by-side orientation with respective to one another, as shown in FIGS. 1 and 2, when the bracing member 18 is contracted to its minimum length.

The apparatus 10 is converted between an erected operative condition (FIG. 3) and a collapsed inoperative transport condition (FIGS. 1 and 2) by respectively extending and contracting the bracing member 18 between its respective unfolded and folded conditions and concurrently rotating the frame 12 relative to the support member 18 between a generally horizontal position and an upright position. More particularly, extension or unfolding of the bracing member 18 pivots the support member 18 relative to the J box 48 and away from the frame 12, and places the support member 18 in the erected operative condition relative to the frame and places the lamp 60 remote from the frame, as seen in FIG. 3. On the other hand, contraction or folding of the bracing member 18 pivots the support member 18 relative to the J box 48 and toward the frame 12, and places the support member 18 in the collapsed inoperative transport condition relative to the frame and places the lamp 60 adjacent to the frame, as seen in FIGS. 1 and 2.

As seen in FIG. 3, the frame 12 is disposed in a generally horizontal position adjacent the ground with its wheels 26 and handle 28 in contact with the ground when the bracing member 18 is extended or unfolded to place the support member 16 in the erected condition relative to the frame 12. On the other hand, the frame 12 is disposed in a generally upright position relative to the ground with its wheels 26 still in contact with the ground but its handle 28 now remote from the ground when the bracing member 18 is contracted or folded to place the support member 18 in the collapsed condition relative to the frame 12. The forwardly-bent edge or flange portion 46 of the platform plate 44 engages the ground at a location spaced forwardly of locations of engagement of the support wheels 26 with the ground such that the platform flange portion 46 and wheels 26 together support the frame 12 in a freestanding relation when the frame is disposed in the upright position relative to the ground. The forwardly-opening expandable and springable retaining clip 38 provides a means mounted on the frame 12 for holding the bracing member 18 in its contracted condition. The pivotal joints between the bracing member bars 18A, 18B and with the cross member 62 and support member 16 are sufficiently tight so that forces of friction created at the joints will maintain the bracing member 18 at any condition it is adjusted to intermediate between its completely folded and unfolded conditions.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A portable light support apparatus, comprising:
(a) an elongated mobile frame;
(b) connecting means mounted on one end of said frame;
(c) lighting means;
(d) an elongated support member pivotally mounted at one end by said connecting means to said one end of said frame for movement of said support member at an opposite end toward and away from said frame, said support member at said opposite end mounting said lighting means at a location spaced remote from said connecting means; and
(e) a bracing member extending between and interconnecting said frame and said support member, said bracing member being adjustable for placing said support member in an erected operative condition relative to said frame and said lighting means remote from said frame and being oppositely adjustable for placing said support member in a collapsed inoperative transport condition relative to said frame and said lighting means adjacent to said frame, said frame being disposed in a generally horizontal position adjacent the ground when said bracing member is adjusted to place said support member in said erected condition relative to said frame and being disposed in a generally upright position relative to the ground when said bracing member is oppositely adjusted to place said support member in said collapsed condition relative to said frame.

2. The apparatus of claim 1 wherein said frame includes ground engaging support wheels rotatably mounted at said one end of said frame.

3. The apparatus of claim 2 further comprising:
(f) a support platform attached on said one end of said frame and mounting said connecting means.

4. The apparatus of claim 3 wherein said platform has an edge portion spaced from said wheels and engagable with the ground such that said platform edge portion and said wheels together support said frame in a freestanding relation when said frame is disposed in said upright position relative to the ground.

5. The apparatus of claim 1 wherein said frame includes a handle attached to an opposite end of said frame.

6. The apparatus of claim 5 wherein said frame further includes ground engaging support wheels rotatable mounted at said one end of said frame, said frame being disposable in said horizontal position relative to the ground by its wheels and handle resting on the ground.

7. The apparatus of claim 1 wherein said connecting means includes an electrical junction box mounted to said one end of said frame, said support element at said one end thereof being pivotally mounted to said junction box.

8. The apparatus of claim 7 wherein said connecting means further includes a swivel connector being fixedly mounted to one of said junction box and said opposite end of said support member and being pivotally mounted to the other of said junction box and said support member opposite end, said support member thereby being pivotally movable via said swivel connector relative to said junction box toward and away from said frame.

9. The apparatus of claim 8 wherein said swivel connector and said support member have hollow interiors providing a path from said lighting means on said support member to the interior of said junction box.

10. The apparatus of claim 9 further comprising:

(f) an electrical cord disposed through the interiors of said support member and said swivel connector and electrically connecting said lighting means and said junction box.

11. The apparatus of claim 1 further comprising:

(f) means mounted on said frame for holding said bracing member in its contracted condition.

12. The apparatus of claim 1 wherein said adjustable bracing member is extendable for placing said support member in said erected operative condition relative to said frame and said lighting means remote from said frame, said bracing member being contractable for placing said support member in said collapsed inoperative transport condition relative to said frame and said lighting means adjacent to said frame.

13. The apparatus of claim 12 wherein said bracing member is composed of a plurality of parts being pivotally connected together and to said support member and said frame, said parts being unfolded into an end-to-end orientation with respect to one another when extended and being folded into a side-by-side orientation with respective to one another when contracted.

14. A portable light support apparatus, comprising:

(a) an elongated frame having ground engaging support wheels rotatable mounted at one end of said frame and a handle attached to an opposite end of said frame;

(b) an electrical junction box mounted at said one end of said frame;

(c) lighting means;

(d) an elongated support member pivotally mounted at one end to said junction box for movement of said support member at an opposite end toward and away from said frame, said support member at said opposite end mounting said lighting means at a location spaced remote from said junction box; and (e) a bracing member extending between and interconnecting said frame and said support member, said bracing member being extendable for placing said support member in an erected operative condition relative to said frame and said lighting means remote from said frame and being contractable for placing said support member in a collapsed inoperative transport condition relative to said frame and said lighting means adjacent to said frame, said frame being disposed in a generally horizontal position adjacent the ground with its wheels and handle in cnntact with the ground when said bracing member is extended to place said support member in said erected condition relative to said frame and being disposed in a generally upright position relative to the ground with its wheels in contact with the ground and its handle remote from the ground when said bracing member is contracted to place said support member in said collapsed condition relative to said frame.

15. The apparatus of claim 14 further comprising:

(f) a swivel connector being fixedly mounted to one of said junction box and said opposite end of said support member and being pivotally mounted to the other of said junction box and said support member opposite end, said support member thereby being pivotally movable via said swivel connector relative to said junction box toward and away from said frame.

16. The apparatus of claim 15 wherein said swivel connector and said support member have hollow interiors providing a path from said lighting means on said support member to the interior of said junction box.

17. The apparatus of claim 16 further comprising:

(g) an electrical cord disposed through the interiors of said support member and said swivel connector and electrically connecting said lighting means and said junction box.

18. The apparatus of claim 14 further comprising:

(f) means mounted on said frame for holding said bracing member in its contracted condition.

19. The apparatus of claim 14 wherein said bracing member is composed of a plurality of parts being pivotally connected together and to said support member and said frame, said parts being unfolded into an end-to-end orientation with respect to one another when extended and being folded into a side-by-side orientation with respective to one another when contracted.

20. A method of converting a portable light support apparatus between erected and collapsed conditions, comprising the steps of:

(a) providing an elongated frame having ground engaging support wheels rotatable mounted at one end of the frame and a handle attached to an opposite end of the frame;

(b) providing an elongated support member pivotally mounted at one end to the one end of the frame for movement of the support member at an opposite end toward and away from the frame, the support member at the opposite end mounting a light at a location spaced remote from one end of the frame;

(c) extending a bracing member to pivot the support member to the erected operative condition relative to the frame and the light remote from the frame;

(d) disposing the frame in a generally horizontal position adjacent the ground with its wheels and handle in contact with the ground upon the extending of the bracing member;

(e) contracting the bracing member to pivot the support member to the collapsed inoperative transport condition relative to the frame and the light adjacent to the frame; and (f) disposing the frame in a generally upright position relative to the ground with its wheels in contact with the ground and its handle remote from the ground upon the contracting of the bracing member.

21. The method of claim 20 wherein said extending of the bracing member comprises the step of unfolding pivotally connected parts of the bracing member into an end-to-end orientation with respect to one another.

22. The method of claim 20 wherein said contracting of the bracing member comprises the step of folding pivotally connected parts of the bracing member into a side-by-side orientation with respective to one another.

* * * * *